US005671566A

United States Patent [19]

Tix et al.

[11] Patent Number: 5,671,566

[45] Date of Patent: Sep. 30, 1997

[54] WINGED JAMB LINER

[75] Inventors: Ronald E. Tix, Hastings; Alvin F. Priem, Minnetonka, both of Minn.

[73] Assignee: Clim-A-Tech Industries, Inc., Hopkins, Minn.

[21] Appl. No.: 527,402

[22] Filed: Sep. 13, 1995

[51] Int. Cl.[6] ..... E05D 13/00

[52] U.S. Cl. ..... 49/419; 49/414; 49/428; 16/197

[58] Field of Search ..... 16/250, 251, 197; 49/414, 419, 422, 428

[56] References Cited

U.S. PATENT DOCUMENTS

| | | | |
|---|---|---|---|
| 1,054,218 | 2/1913 | Lee | 49/428 |
| 1,525,002 | 2/1925 | Sembower | 49/414 |
| 2,236,250 | 3/1941 | Robinson | 49/422 |
| 2,275,955 | 3/1942 | Goellner | 49/422 |
| 3,078,523 | 2/1963 | Martin . | |
| 3,145,433 | 8/1964 | Jones . | |
| 3,441,978 | 5/1969 | Perry . | |
| 4,034,510 | 7/1977 | Huelsekopf . | |
| 4,470,222 | 9/1984 | Killingsworth . | |
| 5,265,308 | 11/1993 | May et al. | 16/197 |
| 5,526,608 | 6/1996 | Starks | 16/197 |

FOREIGN PATENT DOCUMENTS 1006620 10/1965 United Kingdom .

*Primary Examiner*—Daniel W. Howell
*Assistant Examiner*—Mark Williams
*Attorney, Agent, or Firm*—Peterson, Wicks, Nemer & Kamrath, P.A.

[57] ABSTRACT

A jamb liner is mounted in the side jamb tracks of a window frame to mount window units of double hung windows for slidable movement between opened and closed positions. The liner includes transversely spaced channel guides, each guide mounting a guide member that is attached to the adjacent window unit. Flanges are joined to the guides for forming a close fit with the adjacent window unit while, to each guide, there is joined a wing to form a seal with the web of the adjacent jamb to block fluid flow between the window units and the side jamb from one transverse side of the unit sash to the other. The wings of the liner are arcuately curved to transversely diverge from one another in a direction toward the jamb web. The wings are of a substantially greater resiliency than the rest of the liner, said rest of the liner being semi-rigid and made of extruded plastic.

20 Claims, 1 Drawing Sheet

WINGED JAMB LINER

BACKGROUND OF THE INVENTION

This invention relates to a jamb liner for double hung windows.

U.S. Pat. No. 5,265,308 to May et al discloses a plurality of embodiments of a plastic jamb liner, each embodiment including a pair of guide ways with a front web extending therebetween and transversely opposite edge members that, at least in part, are abutable against the window frame abutments. Also, each embodiment includes a pair of spring hinge members for abutting against the window jamb to urge the remainder of the liner outwardly. In one embodiment, the spring members are joined to the guide ways adjacent to the juncture of the rear wall and the side wall that is most closely adjacent to one of the jamb abutments to extend diagonally in the same rearward direction. As to the second embodiment, the spring members are joined to the edge members to transversely converge in a rearward direction while in the third embodiment, the spring members are joined to the adjacent guide side walls of the two guide ways to diverge in a rearward direction. As to each of the embodiments, the part of the spring hinges adjacent to the guides are said to be resilient while the major parts of the width of spring hinges are semi-rigid. Further, as may be seen from the drawings, by far the major part of the width of each of the hinge members extend linearly and is made of the semi-rigid material.

Problems have been encountered in utilizing jamb liners; for example, air and moisture bypassing between the transverse surface of the jamb track and the jamb liner, particularly when the track transverse surface has irregularities against which the jamb liner wings abut. Sponge blocks have been placed in the track between the jamb liner and the window jamb. However, such foam frequently breaks down in 6 to 18 months.

In order to overcome a problem such as the above as well as others, this invention has been made.

SUMMARY OF THE INVENTION

The present invention is directed to jamb liners mountable in the recessed track of the side jambs of the frame for double hung windows which include window units translatorily movable between open and closed positions. Each jamb liner includes a pair of longitudinal elongated channel guides with a web extending therebetween. The guides open to the adjacent side edge of the respective window unit and have guide members mounted in the guides and connected to the adjacent side sashes. Wings, preferably arcuately curved, are joined to the guides of each liner to extend the longitudinal length thereof to diverge away from one another in a rearwardly direction to abut against the adjacent side jamb and along at least part of its rearwardly extending dimension, being of a resiliency for blocking fluid flow between the liner and the side jamb from one side of the sash to the other.

One of the objects of this invention is to provide a new and novel jamb liner to provide an improved seal with the window frame jamb to decrease air infiltration bypass between the window sash and the frame jamb. Another object of this invention is to provide a new and novel jamb liner having flexible polymer wings for abutting against jamb surfaces that will conform to irregularities in the jamb surfaces to form a seal which would not be provided by a rigid wing.

DETAILED DESCRIPTION

Figures 1, 2:
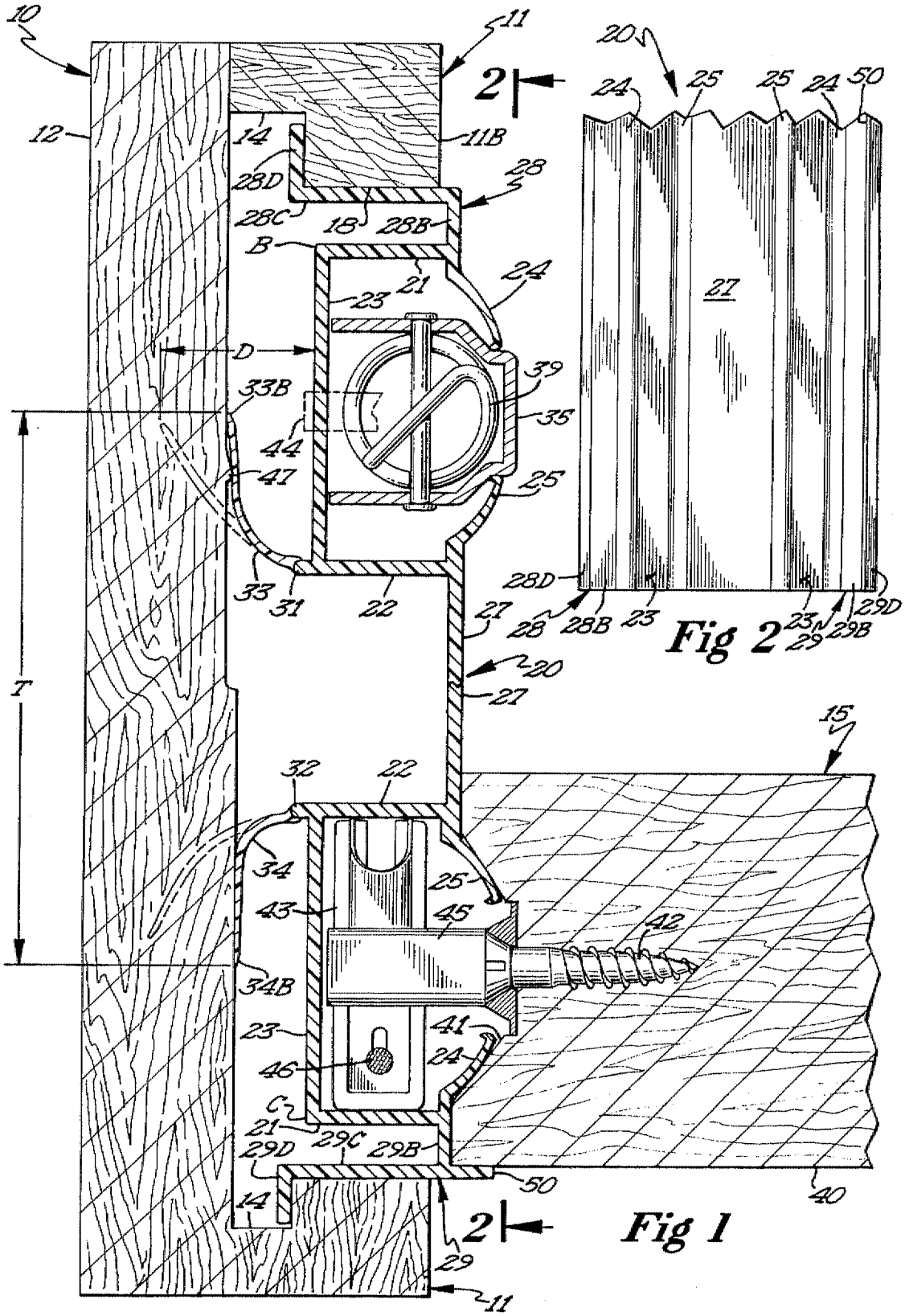
FIG. 1 is an enlarged, transverse cross sectional view of the guide liner of this invention together with adjacent fragmentary portions of the window frame and window sash of a window unit.
FIG. 2 is a fragmentary view of the liner that is generally taken along the line and the direction of the arrows 2—2 of FIG. 1.

Referring to the drawings, there is shown a side jamb member, generally designated 10, of one side of a conventional window frame having a window opening. The frame jamb member 10 includes oppositely facing transversely spaced abutments 11 joined to a frame side web (side jamb) 12 to provide a recessed longitudinal track that includes a generally rectangular groove 18 opening toward the opposite side of the window frame (not shown) and recesses 14 opening transversely toward one another and to the groove 18. The frame abutment 11B is removable to facilitate the installation of the jamb liner of this invention, generally designated 20, in the jamb track even though the liner may be of a rigidity to permit the liner to be snapped into the recessed track. The groove and recesses extend along substantially the longitudinal length of the window frame opening in which the window units, generally designated 15, are slidably mounted for movement between opened and closed positions (only part of one unit being shown).

For each of the frame side jambs, there is provided a jamb liner 20, the jamb liners being designed for use with double hung window units and being mountable within the respective set of recessed tracks 14, 18 to extend the longitudinal length of the tracks and transversely across the tracks. Each jamb liner includes a main body having parallel, transversely spaced, longitudinally elongated channel guides B, C. Each guide has transversely opposite side walls 21, 22 and a rear end wall 23 extending between and joined to the longitudinal rear edges of walls 21, 22. The rear walls are adjacent to the frame web 12, but, during normal usage, are substantially spaced from the frame web 12. To the longitudinal front edges of the transversely spaced walls 21, 22 which are opposite the end wall 23, there are joined forwardly extending main body flanges 24, 25 respectively which initially extend toward one another substantially parallel to the end wall and then forwardly converge toward one another (in a direction away from the respective end wall 23) to terminate substantially transversely spaced from one another.

Joining the channel guides B, C to one another is a front transverse web 27 that extends the length of the guides and forms part of the main body. The web is joined to the guides adjacent to the juncture of the side walls 22, 22 to the respective flange 25, 25 to retain the guides B, C in substantial transverse spaced relationship with the side walls 22 being more closely adjacent one another than side walls 21. Advantageously, when the liner is in a relaxed condition (not contained in a frame track or no other external force applied thereto), the web 27 is generally parallel to the end walls 23 and the side walls 21, 22 are generally parallel to one another.

Also joined to the channel guides are generally Z-shaped retainer flanges 28, 29 respectively that act in cooperation with the abutments to retain the liner extending within the jamb track, the retainer flanges being parts of the liner main body. The adjacent edges of the legs 28B, 29B of the Z-shaped flanges are joined to the respective guide adjacent to the juncture of flanges 24, 24 to the respective side wall 21 to extend away from one another. Also, the flanges 28, 29 have legs 28D, 29D extending into the adjacent recess 14 for abutting against the respective abutment transverse surface which faces the frame web 12 to retain the jamb liner in the jamb track with, advantageously, only a minor portion of the liner extending outwardly of the respective frame track 14, 18. The flange legs 28C, 29C extend between and are joined to the respective set of legs 28B, 28D and 29B, 29D. The legs 28C, 29C abut against the adjacent side surface of the respective abutment 11 which extends outwardly of the recesses 14.

Each of the channel guides has a tab 31, 32 respectively joined to the guide adjacent to the juncture of wall 22 to wall 23 to extend toward the frame web 12 and the longitudinal length of the guides. In the liner relaxed condition, advantageously the tabs are parallel to one another. Joined (affixed) to the tabs 31, 32 to extend rearwardly thereof are one of the longitudinal edge portions of the wings 33, 34 respectively, the wings being the same but oppositely faced.

Advantageously, each of the wings is made of a flexible polymer. The wings extend the length of the tabs to, in the dotted line relaxed position of FIG. 1, initially extend predominantly away from the end walls 23 in the same rearward direction while slightly transversely diverging away from one another and then increasingly transversely diverging from one another to about midway along their arcuate dimensions, and then predominantly diverge away from one another while still extending more remotely from the respective channel guide. Thus, in their relaxed condition, the wings are continuously arcuately curved along their arcuate widths from the tabs to their free terminal longitudinal edges 33B, 34B to transversely diverge from one another and advantageously are of arcuate dimensions along their longitudinal lengths to have their free terminal edges 33B, 34B spaced by a transverse dimension T. Advantageously, the dimension T is such that the terminal edges are transversely spaced about one thirds to two thirds of the transverse dimension of the end wall 23 from the respective channel guide side wall 22 and may be spaced from the end wall of the respective guide a depth dimension D which may be about the same as the corresponding depth dimension of the side wall 22. Further, the depth dimension of each wing in its relaxed condition is much greater than the corresponding dimension of a recess 14 and the spacing of the tabs 31, 32 from the frame web 12.

Each window unit includes opposite sash sides 40, only one being shown. Each sash side has a notch 41 into which the flanges 24, 25 of the respective channel guide extend to form a close fit with at least a portion of the depth of the wall portions defining the notch along the longitudinal length of the window unit. To aid in retaining the window units in the desired opened and closed position in a convention manner, a conventional block and tackle arrangement is provided in each guide channel. The block and tackle arrangement includes a longitudinal elongated mounting channel member 35 which at its upper end is connected to the upper end of the respective guide channel by a clip 44 that is shown in dotted lines in FIG. 1. It is noted that the showing of the structure in guide B is taken at a higher elevation than that in guide C, but at a lower elevation than the attachment of the clip to the main body and the top edge of the main body.

The upper end of a coil spring 39 of each block and tackle arrangement is pinned to the upper end of the respective mounting channel, the spring being located in the respective mounting channel. The lower end of each coil spring is connected to an upper pulley sheave mount (not shown) while a cord 46 extends around upper sheaves (not shown) mounted by the upper pulley sheave mount and the lower sheaves (not shown) which are mounted by a lower pulley sheave mount (not shown). One end of the cord is affixed to the upper pulley sheave mount while the lower end is connected to the arrangement shoe 43 in the respective guide channel that is below the lower sheave mount. The shoe 43 form a close sliding fit in the respective guide channel in a conventional manner.

A cam pivot 45 is mounted to the adjacent sash side by screws 42 with one of or both of the cam pivot and the screws extending between the adjacent free terminal edges of the flanges 24, 25, only one cam pivot being shown. The cam pivot extends in the respective guide channel in abutable, overhanging relationship to the respective shoe to aid in retaining the respective window unit in the desired opened and closed position.

It is to be understood that in place of a block and tackle arrangement, other conventional structure could be provided in the guide channels to aid in retaining the respective window unit in the desired opened or closed position. For example, a balance coil spring can be connected at its lower end to a guide member which is affixed to the adjacent side of the respective sash and an upper end attached to the upper end of the respective guide channel.

The main body also includes a stop flange 50 joined to the retainer flange 29 adjacent the juncture of flange leg 29B to leg 29C to extend generally coextensively with leg 29C in a direction away from leg 29C, this direction being forwardly of the leg 29B. The stop flange is abutable against the adjacent sash 40.

The jamb liner, other than for the wings, is made of an extruded plastic material, for example polyvinylchloride, that is at least semi-rigid, while the wings are made of a resilient plastic material, for example polyurethane. The degree of resiliency of the wings is much greater than that of the rest (main body) of the jamb liner. Also, advantageously, the wings are of arcuate widths such that when in usual use, about 20% to 40% of the arcuate dimension of each wing contacts the jamb web 12 along the longitudinal length of the liner, provided the surface of the adjacent jamb 12 is level. Thus, the resiliency of the wings in combination with the arcuate dimensions of the wings enhances the ability of the liner along its length to block the bypass of moisture and air between the frame jamb and the window units during use, even when there are irregularities (uneven surface or imperfections in the surface portion) 47 in the frame jamb. For example, if the irregularity 47 projects outwardly of the adjacent surface of the frame web and extends only part of the longitudinal length of the jamb, the wing would abut against the part of the jamb that is both above and below the irregularity in longitudinal alignment with the irregularity; and also abut against the jamb on either one or both transverse sides of the irregularity at a location either more closely adjacent to and/or more remote from the tab of guide B along the arcuate surface of the wing than the part of the wing would abut against if the surface of web 12 was planar. Accordingly, there can be an annular or semi-annular space between the wing and the surface of the jamb that surrounds or partially surrounds the irregularity such that the wing blocks the flow of moisture and air between the liner and the jamb transversely from one side of the wing to the other, or would conform to the irregularity.

Even though the terms upper and lower have been used in describing the invention, it is to be understood that jamb liners of this invention may be installed in the window frame recessed tracks of a window frame to mount the window units for longitudinal, vertical or horizontal slidable movement, or longitudinal slidable movement in any other direction between opened and closed positions.

The wings are of a resiliency to maintain their arcuate shape when no external pressure is exerted thereagainst, and to further bow when the liner is mounted to extend in a jamb recessed track in abutting relationship to the frame web surface regardless of whether the track is elongated in a vertical, horizontal or other direction. Further, with the transverse divergent bowing of the wings and the arcuate dimension of the wings, one wing may be further compressed than the other, for example when a greater rearward force is exerted on one channel guide than the other, such that the more compressed wing will have a greater arcuate dimension of its surface in contact with the frame web than the other wing while the said other wing still has a substantial arcuate part of its arcuate surface along its longitudinal length in sealing contact with the frame web.

With the divergence of the wings, when a force is exerted on the guides toward the adjacent side jamb, the force acts to more remotely transversely space the terminal edges 33B, 34B and at the same time, increases the resilient force in the wings that act to resist movement of the guides toward the side jamb. Further, within limits of normal usage, the greater the pressure exerted on the liner outer web and/or the front flanges 24, 25 to move the liner toward the adjacent frame jamb, the greater the arcuate surface area of the wings that contact the window jamb.

Further, when no sash is mounted by the jamb liners, the wings act to retain the retainer flange legs in abutting relationship to the abutment surfaces 11B that in part define the recess 14 and face the web 12 while permitting one or both legs 28D, 29D to move more closely adjacent to the web 12 when a sash is mounted to the channel guides.

Although the wings have been described as being entirely made of a plastic that is substantially more resilient than the jamb liner, it is to be understood that even though less desirable, only the portions of the wings that contacts the webs 12 have to be of such resiliency and the remainder of the wings or a part of the wings intermediate the tabs and the free terminal edges of the wings may be of the same rigidity as that of the jamb liner. Further, even though the wings have been described as being arcuately curved in a rearward direction and such is more preferable, it is to be understood portions of the wings that extend rearwardly may extend linearly as long as sufficient portions of the wings in the direction along the widths of wings toward the webs 12 contact the webs 12 to form a fluid seal therewith. Also the wings may be joined to the main body, other than at the tabs, for example to the main body web 27.

Even though, for the most part, the above description has been with reference to jamb liners mounted in the side tracks of the window frame of vertically slidable, double hung windows, the liners of this invention may be mounted in recessed tracks in the window frame header (not shown) and/or the window frame sill (not shown) that are recessed similar to that shown for the side tracks in FIG. 1. In such an event, the header liner could include guide channels in the form of downwardly opening notches for slidably receiving the top sash member (not shown) of the top window unit (not shown); and the header liner wings would extend upwardly (rearwardly of the main body) and transversely to abut against the header web that in part defines the recessed track of the header. Similarly, the sill liner could include guide channels in the form of upwardly opening notches for slidably receiving the bottom sash member (not shown) of the bottom window unit and the wings would abut against the sill web that in part defines the recessed track of the sill. Suitable gaskets can be included on the sash members and/or the guide channels of the header and the sill liners providing an air seal when the window units are in a closed position.

What is claimed is:

1. A longitudinally elongated liner mountable in a recessed track of a window frame having a window frame opening for abutting against the sash of a window unit that is mounted for slidable movement in the window frame, comprising a longitudinally elongated main body that includes a longitudinally elongated channel guide, the guide including transversely spaced first and second side walls that have front edges and a rear wall extending between and joined to the side walls, and means joined to the channel guide for extension into the recessed track for mounting the guide to the window frame, said means including first and second retainer flanges, and a wing affixed to the main body to extend the longitudinal length of the main body and rearwardly of the main body, said wing having a free terminal longitudinal edge, and a fluid sealing portion extending the longitudinal length of the main body for forming a fluid seal with the window frame rearwardly of the main body, at least said fluid sealing portion of the wing being of a substantially greater resiliency than the main body.

2. The liner of claim 1, wherein the wing along its entire width is of substantially greater resiliency than the main body.

3. The liner of claim 1, wherein the wing has a longitudinal edge portion affixed to the guide adjacent to the juncture of the rear wall to one of the side walls.

4. The liner of claim 3, wherein the guide includes a tab integrally extending continuously from the one of the side walls rearwardly beyond the rear wall, with the longitudinal edge portion of the wing being affixed to the tab.

5. The liner of claim 1, wherein the wing fluid sealing portion comprises an arcuately curved portion that extends along at least the major portion of the wing's entire width toward the wing's terminal edge to extend rearwardly and transversely.

6. The liner of claim 1, wherein said means includes a second longitudinally elongated channel guide, the second guide having transversely spaced third and fourth side walls that have front edges and a rear wall extending between and joined to the third and fourth side walls remote from the third and fourth side wall front edges and a front web extending transversely between the second and third side walls and being joined to the second and third side walls adjacent to their front edges, the second retainer flange being joined to the side wall, and a second resilient wing affixed to the main body in transverse spaced relationship to the first wing to extend the longitudinal length of the main body and rearwardly of the channel guides, said second wing having a free terminal, longitudinal edge rearwardly remote of the main body and a fluid sealing portion that extends the longitudinal length of the main body for forming a fluid seal with the window frame rearwardly of the main body, at least said fluid sealing portion of the second wing being of a substantially greater resiliency than the main body.

7. The liner of claim 6, wherein the wings transversely diverge from one another in a direction rearwardly of the guides.

8. The liner of claim 7, wherein the first wing is affixed to the first guide adjacent to the juncture of the second wall to the first rear wall and the second wing is affixed to the second guide adjacent to the juncture of the third wall to the second rear wall.

9. The liner of claim 8, wherein the first guide includes a tab integrally extending continuously from the second wall beyond the first rear wall, with the first wing having a longitudinal edge portion affixed to the tab of the first guide;

and wherein the second guide includes a tab integrally extending continuously from the third wall beyond the second rear wall, with the second wing having a longitudinal edge portion affixed to the tab of the second guide, with the tabs of the first and second guides being parallel.

10. The liner of claim 6, wherein the wings are arcuately curved along substantially their entire arcuate widths to, in a relaxed condition, initially extend predominantly rearwardly while diverging transversely from one another and thence predominantly diverge transversely while extending further rearwardly.

11. The liner of claim 1, wherein the main body is made of plastic and is at least semi-rigid; and wherein the wings include a portion that contacts the window frame and that is made of a type of plastic that is different from the type used for making the main body.

12. The liner of claim 11, wherein the wing along its entire width is of substantially greater resiliency than the main body.

13. A longitudinally elongated jamb liner mountable in a recessed track of a window jamb of a window frame having a window frame opening to cooperate with a sash of a window unit to mount the window unit fur slidable movement in the window frame, comprising a main body that is made of plastic and is at least semi-rigid, the main body including a pair of longitudinally elongated, transversely spaced first and second channel guides, each guide having transversely spaced first and second side walls and a rear wall extending between the side walls, and retainer flanges joined to the channel guides adapted to extend into the recessed track for mounting the guides to the window frame, and a first and a second arcuately curved wing joined to the first and second guides respectively, the wings being arcuately curved to extend rearwardly of the guides in a diverging relationship to one another, the wings along their arcuate widths being of a much greater resiliency than the main body.

14. The jamb liner of claim 13, wherein the wings along their arcuate widths initially predominantly extend rearwardly of the guides while diverging away from one another and thereafter extend predominantly away from one another while extending further rearwardly of the guides.

15. The jamb liner of claim 14, wherein the first side walls of the guides are further transversely spaced than the second side walls of the guides, and each guide includes a tab made of the plastic of the main body and integrally affixed adjacent to the juncture of its rear wall and second side wall, the tab extending rearwardly of the rear walls, and the wings are joined to the tabs.

16. The jamb liner of claim 15, wherein the side walls have front longitudinal edges, the main body includes a front web extending transversely between and joined to the second side walls adjacent to the side wall front edges to retain the guides in transverse spaced relationship and each guide includes longitudinally elongated front flanges joined to the adjacent side wall, to at along at least a part of their widths, converge toward one another in a direction away from the respective guide rear wall and have free terminal longitudinal edges substantially transversely spaced from one another.

17. The jamb liner of claim 16, wherein the wings include a portion that contacts the window frame and that is made of a type of plastic that is different from the type used for making the main body.

18. The jamb liner of claim 15, wherein the tabs of the first and second channel guides are parallel to one another.

19. The jamb liner of claim 13, wherein the first and second wings are arcuately curved along at least a major portion of the entire widths of the wings.

20. The jamb liner of claim 13, wherein the wings include a portion that contacts the window frame and that is made of a type of plastic that is different from the type used for making the main body.

* * * * *

UNITED STATES PATENT AND TRADEMARK OFFICE
CERTIFICATE OF CORRECTION

PATENT NO. : 5,671,566

DATED : September 30, 1997

INVENTOR(S) : Ronald E. Tix et al.

It is certified that error appears in the above-identified patent and that said Letters Patent is hereby corrected as shown below:

Column 3, line 35, cancel "thirds" and substitute therefor --third--.

Column 6, line 46, after "the" insert --fourth--.

Column 7, line 23, cancel "fur" and substitute therefor --for--.

Signed and Sealed this

Sixteenth Day of December, 1997

*Attest:*

Bruce Lehman

BRUCE LEHMAN

*Attesting Officer*

*Commissioner of Patents and Trademarks*